United States Patent [19]

Kashiwagi et al.

[11] Patent Number: 4,554,425

[45] Date of Patent: Nov. 19, 1985

[54] CONTACT OF VACUUM INTERRUPTER AND MANUFACTURING PROCESS THEREFOR

[75] Inventors: Yoshiyuki Kashiwagi; Yasushi Noda, both of Tokyo; Kaoru Kitakizaki, Higashimine, all of Japan

[73] Assignee: Kabushiki Kaisha Meidensha, Tokyo, Japan

[21] Appl. No.: 648,362

[22] Filed: Sep. 7, 1984

[30] Foreign Application Priority Data

Sep. 24, 1983 [JP] Japan ..... 58-176764

[51] Int. Cl.[4] ..... H01H 33/66

[52] U.S. Cl. ..... 200/144 B; 200/262; 200/265; 200/266

[58] Field of Search ..... 200/144 B, 262, 265, 200/266

[56] References Cited

U.S. PATENT DOCUMENTS 3,246,979 4/1966 Lafferty ..... 200/144 B 3,596,927 7/1927 Okutomi ..... 200/144 B

*Primary Examiner*—Robert S. Macon

*Attorney, Agent, or Firm*—Lowe, King, Price & Becker

[57] ABSTRACT

A contact of a vacuum interrupter and a manufacturing process therefor are disclosed. The contact can greatly reduce the chopping current of the interrupter, can greatly increase the dielectric strength thereof and can improve the large- and small-current interrupting capabilities thereof. The contact is made of a material containing 29 to 74 weight % copper, 15 to 60 weight % chromium, 10 to 35 weight % iron, 0.5 to 15 weight % carbon and 0.5 to 15 weight % silicon. The process contains the steps of producing a porous matrix by sintering a mixture of all of the elements except copper under a nonoxidizing atmosphere, impregnating the matrix with copper and machining the resultant material.

6 Claims, 7 Drawing Figures

CONTACT OF VACUUM INTERRUPTER AND MANUFACTURING PROCESS THEREFOR

BACKGROUND OF THE INVENTION

1. Field of the Invention

The present invention relates to a contact of a vacuum interrupter and to a manufacturing process therefor.

2. Description of the Prior Art

Generally, a contact of a vacuum interrupter should consistently meet the following requirements:

(i) high large-current-interruption capability,
(ii) high dielectric strength,
(iii) high small-current interruption capability,
(iv) low chopping current level,
(v) excellent anti-welding capability, and
(vi) low electrical resistance.

However, contacts of vacuum interrupters which can consistently meet all the above requirements are not yet available, given the present state of the art.

For example, U.S. Pat. Nos. 3,246,979 and 3,596,027 disclose, as a contact for a vacuum interrupter of magnetically arc-rotating type, a contact made of a Cu-0.5Bi alloy (hereinafter referred to as a Cu-0.5Bi contact) in which copper contains 0.5% by weight bismuth as a minor constituent with a high vapor-pressure and a low melting point.

A vacuum interrupter with a pair of Cu-0.5Bi contacts exhibits high large-current-interruption capability, excellent anti-welding capability and low electrical resistance, but remarkably low dielectric strength, particularly, a low dielectric strength immediately after a large-current interruption and a chopping current with a level as high as 10 A, so that it is susceptible to chopping surge during a current interruption. Thus, the interrupter can only poorly interrupt small-currents, particularly, inductive small-currents, which tends to lead to dielectric breakdown of electrical devices in inductive load circuits connected to the interrupter.

In addition, Japanese examined patent application publication No. 53-6710 and Japanese unexamined patent application publication No. 51-95291 disclose, as a contact for a vacuum interrupter which is designed to eliminate the drawbacks of the above-mentioned contact, a contact made of an Ag-WC alloy (hereinafter referred to as an Ag-WC contact) consisting of Ag and a material with a low vapor-pressure and a high melting point.

A vacuum interrupter with a pair of Ag-65WC contacts exhibits a chopping current with a level as low as 1.6 to 2.0 A but low large-current-interruption capability. An Ag-WC contact, which contains a relatively large amount of Ag, is expensive and has another drawback in that it is impossible to braze, particularly, to vacuum-braze at temperatures in excess of 950° C.

SUMMARY OF THE INVENTION

An object of the present invention is to provide a contact which can greatly reduce the chopping current level of a vacuum interrupter.

Another object of the present invention is to provide a contact which can greatly increase the dielectric strength of a vacuum interrupter.

Still another object of the present invention is to provide a contact with which a vacuum interrupter can reliably interrupter both large and small currents.

In order to accomplish these objects of the present invention, a contact is made of a material consisting of between 29 and 74% by weight copper, between 15 and 60% by weight chromium, between 10 and 35% by weight iron, between 0.5 and 15% by weight carbon, and between 0.5 and 15% by weight silicon. A vacuum interrupter with a pair of contacts made of this material, compared to a vacuum interrupter with a pair of Cu-0.5Bi contacts and a vacuum interrupter with a pair of Ag-65WC contacts, has 6% and 60% of the levels of chopping current of the respective comparison interrupters, 3 times dielectric strength of the other interrupters, equal to and about 3.3 times the large-current-interruption capabilities of the respective interrupters, 1.5 and 3 times the capacitive small-current-interruption capabilities of the respective interrupters, and equal to and about 80% of the anti-welding capabilities of the respective interrupters.

Still another object of the present invention is to provide a process specially adapted for the manufacture of the contact. According to the process, the secondary constituents in the form of granules or powder are mixed, the resulting mixture is heated at a temperature below the melting point of silicon under a nonoxidizing atmosphere, resulting in a porous matrix consisting of all of the secondary constituents, and the porous matrix is impregnated with copper under a nonoxidizing atmosphere, and a piece of the resulting composite material is machined in order to obtain a contact of the desired shape for a vacuum interrupter.

The porous matrix may alternatively be produced from granules or powder of ferrochromium alone.

Other objects and advantages of the present invention will be apparent from the following description, claims and attached drawing and photomicrographs.

BRIEF DESCRIPTION OF THE DRAWING AND PHOTOGRAPHS

FIG. 2A shows the secondary electron image of the microstructure;

FIG. 2B shows the characteristic X-ray image of the chromium component;

FIG. 2C shows the characteristic X-ray image of the iron component;

FIG. 2D shows the characteristic X-ray image of the carbon component;

FIG. 2E shows the characteristic X-ray image of the silicon component; and

FIG. 2F shows the characteristic X-ray image of the infiltrating copper.

DESCRIPTION OF THE PREFERRED EMBODIMENTS

Referring to FIGS. of the accompanying drawing and photomicrographs the preferred embodiments of the present invention will be described in detail hereinafter.

Figure 1:
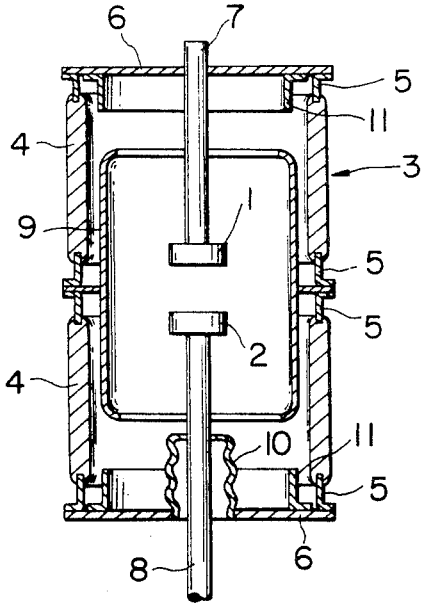
FIG. 1 is a sectional view through a vacuum interrupter with a pair of contacts of the present invention.

As shown in FIG. 1, a vacuum interrupter has a pair of stationary and movable contacts 1 and 2 of the present invention within its vacuum envelope 3. The vacuum envelope 3 comprises, in the main, two insulating cylinders 4 made of insulating glass or ceramics which are coaxially aligned end-to-end, four thin-walled cylindrical metallic sealing rings 5 made of a Fe—Ni—Co or Fe—Ni alloy and fixed to opposite ends of each insulating cylinders 4, two end plates 6 made of metal such as austenitic stainless steel hermetically fixed to the open ends of the insulating cylinders 4 by means of metallic sealing rings 5, a stationary electrical lead rod 7 for the stationary contact 1, a movable electrical lead rod 8 for the movable contact 2, and a metal bellows 10 hermetically connecting the movable electrical lead rod 8 to one of the end plates 6. The chamber of the vacuum envelope 3 is evacuated to a pressure, e.g., of at highest 13.4 mPa ($10^{-4}$ Torr).

A cylindrical arc shield 9 made of metal such as austenitic stainless steel surrounds the stationary and movable contacts 1 and 2 and has a flange sandwiched hermetically between the two sealing rings 5 joining the insulating cylinders 4, whereby the arc shield 9 is fixed in place relative to the insulating cylinders 4. The arc shield 9 serves to prevent metal vapor, generated on closing and separating of the stationary and movable contacts 1 and 2, from precipitating onto the inner walls of the insulating cylinders 4.

An annular, metallic edge shield 11 made of the same material as arc shield 9, which serves to moderate the concentration of electrical fields at boundaries formed by the sealing ring 5 fixed to the open end of each insulating cylinder 4 and each insulating cylinder 4, is fixed to the inner surface of each end plate 6.

Each of the stationary and movable contacts 1 and 2 is made of a material consisting essentially of between 29 and 74% by weight copper, between 15 and 60% by weight chromium, between 10 and 35% by weight iron, between 0.5 and 15% by weight carbon, and between 0.5 and 15% by weight silicon.

The contacts were manufactured by the following processes. All metal powders were screened to minus 100 meshes.

THE FIRST MANUFACTURING PROCESS

First, a predetermined amount (e.g., the mass of one finished contact plus a machining margin) of chromium powder, iron powder, carbon powder and silicon powder, which constitute respectively between 15 and 60% by weight chromium, between 10 and 35% by weight iron, between 0.5 and 15% by weight carbon, and between 0.5 and 15% by weight silicon but in total between 26 and 71% by weight of the finished product, are mechanically mixed to a homogenous mixture.

Next, the resultant powder mixture is placed in a circular vessel made of a material, e.g., alumina ceramics, which is inert with respect to chromium, iron, carbon, silicon and copper. The powder mixture is held under a nonoxidizing atmosphere, e.g., a vacuum of a pressure of at highest 6.67 mPa ($5\times10^{-5}$ Torr), or an atmosphere of hydrogen, nitrogen or argon gas, at a temperature below the melting point of silicon, e.g., at a temperature between 600° and 1,000° C. for a fixed period of time, e.g., between about 5 and 60 min, thus resulting in a porous matrix in which particles of chromium, iron, carbon and silicon are diffusively bonded.

Next, in the same nonoxidizing atmosphere as in the step of producing the porous matrix, e.g., a vacuum of a pressure of at highest 6.67 mPa ($5\times10^{-}$Torr), or other nonoxidizing atmosphere, a piece of solid copper in bulk or powder is placed on the porous matrix, and then the porous matrix and the piece of solid copper are held at a temperature (e.g., 1,100° C.) of at least the melting point of copper (1,083° C.) but below the melting point of the porous matrix for between about 5 and 20 min, which allows the copper to infiltrate the porous matrix. After a cooling step, the resultant product is machined to form a contact of the desired shape.

The step of producing the porous matrix may be performed under any of various nonoxidizing atmospheres, e.g., hydrogen, nitrogen or argon gas, but the step of impregnating the matrix with copper should be performed under vacuum to degas the resultant product.

In practice, a columnar porous matrix with enough mass for many of the disc-shaped contacts may be produced, and then the columnar porous matrix may be divided into many disc-shaped porous matrices each corresponding to one contact, and then a product having a shape similar to that of the desired contact may be obtained through the copper impregnation step under vacuum.

THE SECOND MANUFACTURING PROCESS

First, a piece of solid copper is placed on a powder mixture for a porous matrix consisting of chromium powder, iron powder, carbon powder and silicon powder, which powder mixture is prepared in the same manner as in the first manufacturing process and which is placed in a circular vessel.

Next, the powder mixture and the piece of solid copper in the vessel is held under a nonoxidizing atmosphere, e.g., a vacuum of a pressure of at highest 6.67 mPa ($5\times10^{-5}$ Torr), at a temperature below the melting point of copper, e.g., at a temperature between 600° and 1,000° C. for a fixed period of time, e.g., between about 5 and 60 min, thus resulting in a porous matrix consisting of chromium, iron, carbon and silicon.

Next, in the same nonoxidizing atmosphere as in the step of producing the porous matrix, the resultant porous matrix and the piece of solid copper are held at a temperature of at least the melting point of copper and below the melting point of the porous matrix, e.g., at 1,100° C. for a fixed period of time of between about 5 and 20 min, which allows the copper to infiltrate the porous matrix. After a cooling step, the resultant product is machined to form a contact of the desired shape.

In the first and second processes, when all or a part of the chromium, iron, carbon and silicon are supplied in the form of commercially available ferrochromium powder, high-carbon ferrochromium (according to JIS, FCrH0, FCrH1, FCrH2, FCrH3, FCrH4 and FCrH5) powder and medium-carbon ferrochromium (according to JIS, FCrM3 and FCrM4) powder can be used as is, but low-carbon ferrochromium (according to JIS, FCrL1, FCrL2, FCrL3 and FCrL4) powder must be used in conjunction with predetermined amounts of carbon powder and silicon powder. If necessary, carbon powder and silicon powder should be added to high-carbon ferrochromium powder or medium-carbon ferrochromium powder as well.

In both the processes, vacuum is preferable to other nonoxidizing atmospheres, because degassing of the material for the contact can be performed under the vacuum. However, if reducing or inert gases are used as the nonoxidizing atmosphere, this will not have deleterious effects on the contact.

In addition, when the temperature and period of time of the porous matrix producing step are being determined, such considerations as the conditions in the vacuum furnace or other gas furnace, the shape and size of the porous matrix to be produced and workability must be taken into account so that the contact will have the desired properties. For example, a heating temperature of 600° C. necessitates a heating of 60 min whereas a heating temperature of 1,000° C. requires a heating period of only 5 min.

The size of each component may be minus 60 meshes, i.e., no larger than 250 μm. However, generally, the larger the upper limit of the particle size, the more difficult it is to uniformly distribute the particles of all the constituents (except in case where only a commercial ferrochromium powder is used). Conversely, it is more complicated to handle finer particles and, when used, they will require pretreatment because they are more susceptible to oxidation.

On the other hand, if the size of each particle exceeds 60 meshes, it is necessary to increase the heating temperature or period since the diffusion distance of each component particle is increased, which translates into a lower productivity of the porous matrix production step. Consequently, the upper limit of the size of the component particles should be selected in view of these conflicting considerations.

The component particles are chosen to be of minus 100-mesh size because the particles of all of the components can be more uniformly distributed, resulting in better diffusion bonding of the component particles and thus better properties for the contact. If the component particles are unevenly distributed, then the drawbacks of each component will not be offset by the others and the advantages thereof will not be as completely developed. In particular, as the component particle size increases beyond 60-mesh, the proportion of copper on the surface of the contact increases significantly, which contributes to a lower dielectric strength of the vacuum interrupter, and the grain sizes of the components and alloys of the different components on the surface of the contact increases, so that the drawbacks but not the advantages of each component will be more apparent.

FIGS. 2A through 2F are photomicrographs taken by the X-ray microanalyzer of the microstructures of the material for the contact produced according to the first process. This material is composed of 50% by weight copper, 30% by weight chromium, 12% by weight iron, 3% by weight carbon and 5% by weight silicon.

Figure 2A:
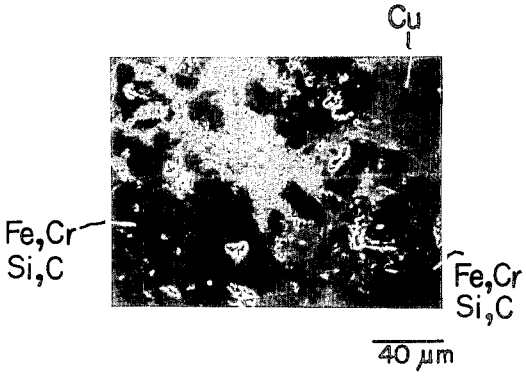
FIGS. 2A through 2F are photomicrographs taken by an X-ray microanalyzer of the microstructure of a material for the contacts of an embodiment of the present invention which material is composed of 50% by weight copper, 30% by weight chromium, 12% by weight iron, 3% by weight carbon and 5% by weight silicon, of which photomicrographs.
Figure 2B:
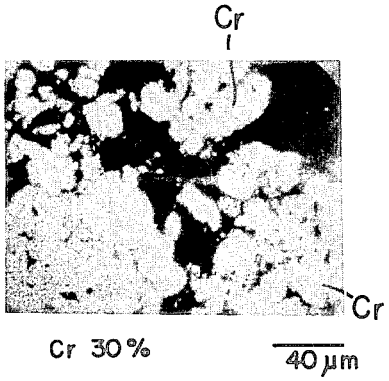
Figure 2C:
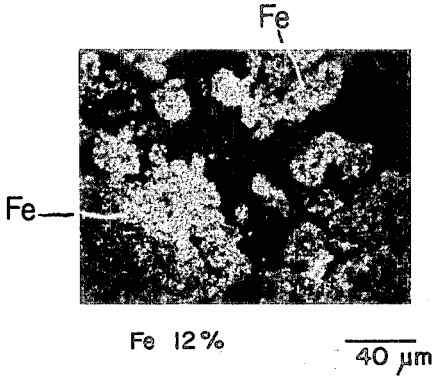
Figure 2D:
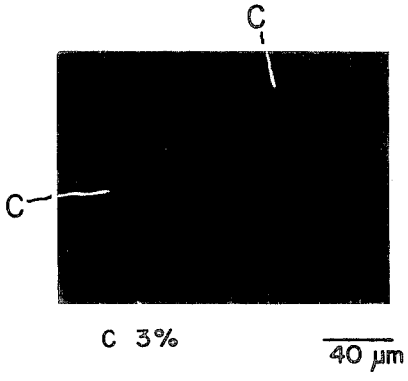
Figure 2E:
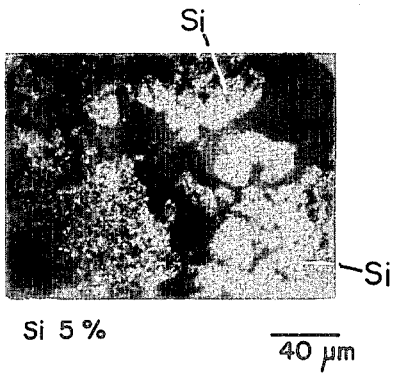
Figure 2F:
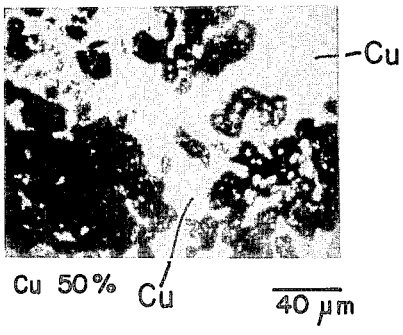

FIG. 2A is the secondary electron image of the microstructure of the material. Chromium, iron, carbon and silicon show up as light areas in FIGS. 2B–2E respectively and can be seen to be generally uniformly mixed to form the porous matrix. In addition, as apparent from FIG. 2F, the copper component which shows up in the lighter areas of this Fig. infiltrates the porous matrix. FIG. 2B shows the characteristic X-ray image of the distributed and diffused chromium component, in which the distributed light agglomerates represent concentrations of chromium. FIG. 2C shows the characteristic X-ray image of the distributed and diffused iron component, in which the distributed light insular agglomerates represent iron. FIG. 2D shows the characteristic X-ray image of the distributed and diffused carbon component, in which the lighter points represent carbon. FIG. 2E shows the characteristic X-ray image of the distributed and diffused silicon component, in which the distributed light insular agglomerates represent silicon. FIG. 2F shows the characteristic X-ray image of the copper infiltrant, in which the light areas represent copper.

The composite materials shown in FIGS. and described above where shaped into disc-shaped contacts with a 50 mm diameter, a 6.5 mm thickness and 4 mm-radius edges. A pair of the contacts were built into a vacuum interrupter as shown FIG. 1 and tests were carried out on the performance of this interrupter. The results of the tests will described hereinafter.

In this description, values of voltage and amperage will be described in RMS values.

(1) Large-current interrupting capability

A 12 kA-current could be interrupted.

(2) Dielectric strength

In accordance with JEC-181 test method, an impulse-withstand voltage test was carried out at a 3.0 mm inter-contact gap. The interrupter showed a 100 kV withstand voltage against both positive and negative impulses with a deviation of ±10 kV.

After interrupting a 12-kA current 10 times, the same impulse-withstand voltage test was carried out in order to verify the above results.

After a 10,000-times-small-current-continuous-switching test was performed at a current of 80 A, the same impulse withstand voltage test was carried out in order to verify these results.

(3) Capacitive small-current interrupting capability

In accordance with a capacitive small-current interrupting test standard of JEC-181, a test capacitive small-current of 80 A at $36\times1.25/\sqrt{3}$ kV was sent through the stationary and movable contacts 1 and 2, and the 10,000-times-small-current-continuous-switching test was performed. No re-ignition occurred.

(4) Level of chopping current

In accordance with an inductive small-current interrupting test standard of JEC-181, a 30-A test current at $84\times1.5/\sqrt{3}$ kV was sent through the stationary and movable contacts 1 and 2. The chopping current averaged 0.6 A (with a standard deviation $\sigma_n=0.6$ over $n=100$ samples).

In addition, the chopping current immediately after large-current interruption averaged 0.6 A ($\sigma_n=0.4$ and $n=100$).

(5) Anti-welding capability

In accordance with the IEC short-time current standard, a 20-kA current was sent for 3s through the stationary and movable contacts 1 and 2 which were forced into contact under a 1,275N (130 kgf) force. The stationary and movable contacts 1 and 2 were then separated smoothly under a 1,961N (200 kgf) static separating force. The increase in electrical contact resistance was limited to within 2 to 8%.

Additionally, in accordance with the IEC short-time current standard, a 50-kA current was sent for 3s through the stationary and movable contacts 1 and 2 which were forced into contact under a 9,807N (1,000 kgf) force. The stationary and movable contacts 1 and 2 were then separated smoothly under a 1,961N (200 kgf) static separating force. The increase in electrical contact resistance was limited to within 2 to 10%. Consequently, the stationary and movable contacts 1 and 2 in fact exhibit good anti-welding capability.

As apparent from the items (1) to (5), the pair of contacts of the present invention possess excellent properties in view of the above-mentioned criteria for contacts for vacuum interrupters.

The performance of a vacuum interrupter with a pair of contacts of the present invention (hereinafter referred to as an interrupter with the present contacts), the performance of a vacuum interrupter with a pair of Cu-0.5Bi contacts having the same shape as the contacts of the present invention (hereinafter referred to as an interrupter with the Cu-0.5Bi contacts) and the performance of a vacuum interrupter with a pair of Ag-65WC contacts having the same shape as the contact of the present invention (hereinafter referred to as an interrupter with the Ag-65WC contacts) were compared. The results of the comparison were described hereinafter.

(a) Large-current interruption capability

The capabilities of the interrupter with the present contacts and interrupter with the Cu-0.5Bi contacts were equal. The capability of the interrupter with the Ag-65WC contacts was 30% of that of the interrupter with the present contacts.

(b) Dielectric strength

The impulse withstand voltage of the interrupter with the present contacts measured at the 3.0 mm inter-contact gap was equal to those of the interrupter with the Cu-0.5Bi contacts and interrupter with the Ag-65WC contacts measured at a 10 mm inter-contact gap. In contrast, the interrupter with the present contacts exhibits 3 times and more the dielectric strength of the other interrupters.

(c) Capacitive small-current interrupting capability

The interrupter with the present contacts could interrupt 1.5 times more capacitive current than the interrupter with the Cu-0.5Bi contacts and 3 times more capacitive current than the interrupter with the Ag-65WC contacts.

(d) Level of chopping current

The chopping current of the interrupter with the present contacts decreased to 6% of the chopping current of the interrupter with the Cu-0.5Bi and to 60% of the chopping current of the interrupter with the Ag-65WC contacts.

(e) Anti-welding capability

The anti-welding of the present contacts was equal to the anti-welding of the Ag-65WC contacts but was only 80% of the Cu-0.5Bi contacts. However, this reduction is not actually significant. If necessary, the force at a moment when the contacts are separated may be slightly increased.

The following limits on the proportions of each component in the material for the contact of the present invention have been recognized.

Less than 15% by weight chromium significantly increases the chopping current. On the other hand, more than 60% by weight chromium significantly reduces the large-current interrupting capability.

Less than 10% by weight iron significantly increases the chopping current. On the other hand, more than 35% by weight iron significantly reduces the large-current interrupting capability.

Less than 0.5% by weight carbon significantly increases the chopping current. On the other hand, more than 15% by weight carbon reduces the dielectric strength.

Less than 0.5% by weight silicon significantly increases the chopping current. On the other hand, more than 15% by weight silicon significantly reduces the large-current interrupting capability.

Less than 29% by weight copper significantly reduces the electrical conductivity of the contacts themselves and increases electrical contact resistance between the contacts. On the other hand, more than 74% by weight copper significantly reduces the dielectric strength and anti-welding capability.

What is claimed is:

1. A contact of a vacuum interrupter, wherein a material of the contact consists essentially of between 29 and 74% by weight copper, between 15 and 60% by weight chromium, between 10 and 35% by weight iron, between 0.5 and 15% by weight carbon, and between 0.5 and 15% by weight silicon.

2. A contact as defined in claim 1, wherein all of the chromium, iron, carbon and silicon are derived from a commercial ferrochromium powder.

3. A contact as defined in claim 1, wherein part of the chromium, iron, carbon and silicon are derived from a commercial ferrochromium powder.

4. A contact as defined in claim 1, wherein the chromium, iron, carbon and silicon components form a porous matrix which is impregnated with copper.

5. A contact as defined in claim 4, wherein the porous matrix contains the chromium, iron, carbon and silicon derived from a commercial ferrochromium mixture.

6. A process for manufacturing a contact of a vacuum interrupter which comprises the steps of:

producing a porous matrix consisting essentially of between 15 and 60% by weight chromium, between 10 and 35% by weight iron, between 0.5 and 15% by weight carbon, and between 0.5 and 15% by weight silicon, the respective proportions of these elements being based on a finished product and the total proportion of these elements amounting to between 26 and 71% by weight of the finished product, and a mixture of these elements being heated at a temperature below the melting point of silicon under a nonoxidizing atmosphere;

impregnating the porous matrix with between 29 and 74% by weight copper on the basis of the finished product under a nonoxidizing atmosphere; and machining the resultant material.

* * * * *